US006547705B2

(12) United States Patent
Yu

(10) Patent No.: US 6,547,705 B2
(45) Date of Patent: Apr. 15, 2003

(54) EXERCISING APPARATUS

(76) Inventor: Simon S. C. Yu, 3806 Whittle Ave., Oakland, CA (US) 94602

( * ) Notice: Subject to any disclaimer, the term of this patent is extended or adjusted under 35 U.S.C. 154(b) by 0 days.

(21) Appl. No.: 09/749,060

(22) Filed: Dec. 28, 2000

(65) Prior Publication Data

US 2002/0086778 A1 Jul. 4, 2002

(51) Int. Cl.[7] ..... A63B 21/00
(52) U.S. Cl. ..... 482/112; 482/142; 482/130
(58) Field of Search ..... 482/112, 77, 908, 482/5–9, 133, 142, 130, 128, 129

(56) References Cited

U.S. PATENT DOCUMENTS 2,068,578 A * 1/1937 Stronach ..... 482/113
2,793,036 A * 5/1957 Hansburg ..... 482/77
3,369,403 A * 2/1968 Carlin et al. ..... 482/112
4,880,230 A * 11/1989 Cook ..... 482/112
4,951,941 A * 8/1990 Resk ..... 482/113
5,910,073 A * 6/1999 Conner ..... 482/124

* cited by examiner

*Primary Examiner*—Jerome Donnelly
(74) *Attorney, Agent, or Firm*—Theodore J. Bielen, Jr.

(57) ABSTRACT

An exercise device comprising a pneumatic hand pump with a valve in the exhaust port. The hand pump is pivotally attached to a folding metal chair or, in an alternate embodiment, to an elongated step board for easy use and storage and provides exercise and muscle toning when pumped against a strong force caused by a nearly closed valve in the exhaust port.

8 Claims, 4 Drawing Sheets

EXERCISING APPARATUS

This invention relates to exercising devices and in particular to a portable exerciser comprising a hand pump with an adjustable needle valve in the exhaust orifice for providing a controlled resistance to the pumping action.

BRIEF SUMMARY OF THE INVENTION

There are many types and models of exercise devices presently in use by commercial gymnasiums and weight clinics as well as by individuals who desire to trim the body. Unfortunately, most people soon find the commercial gyms and weight clinics inconvenient and expensive and the tread mill or stationary bike taking too much space in the home or not adequately exercising the abdominal muscles.

This invention is for a portable, lightweight exerciser particularly adaptable for exercising the abdominal muscles and comprising a preferably hand pump with valved exhaust so that the pump offers some controlled resistance to both handle lifting and compressing. The hand pump is preferably hinged to the back of a folding chair for easy storage requiring a minimum area. In this configuration, the user may sit on the chair, facing backwards, and exercise the arm and abdominal muscles by manipulating the pump at arms length. Or the user may stand behind the folding chair and exercise the same muscles by bending forward and pumping downward at arms length.

In another embodiment, the invention may be hinged to the end of a board or platform upon which the user stands, bent forward, while the hand pump is being manipulated. A third embodiment employs a relatively large hook on the bottom of the hand pump of the invention. This is designed to hook on to the back of a sofa or on a mattress and is manipulated in the same manner as the pump on the folding chair.

The invention has a digital counter that counts the strokes taken by the hand pump and also includes an acoustic synchronizer announcer which may be helpful. The announcer is a device that is connected to the air exhaust of the hand pump that emits an audible tone while air is being exhausted, and can be a signal to the user when to inhale and exhale.

Muscle stimulation is achieved by the bending and straightening of the body. For example, in the folding chair embodiment, the user may start by standing behind the chair with body erect and hands gripping tee handle of the invention. He then leans forward while pushing down the piston while holding his breath and contracting his abdominal muscles. When the handle reaches the bottom of its stroke, the user exhales, his body is bent the maximum amount and the hand pump is supporting him. As he pulls the hand pump handle and himself back up to the original starting position, he is exerting more work on the abdominal muscles.

DESCRIPTION OF THE DRAWINGS

In the drawings that illustrate preferred embodiments of the invention.

DETAILED DESCRIPTION OF THE PREFERRED EMBODIMENT

Figure 1:
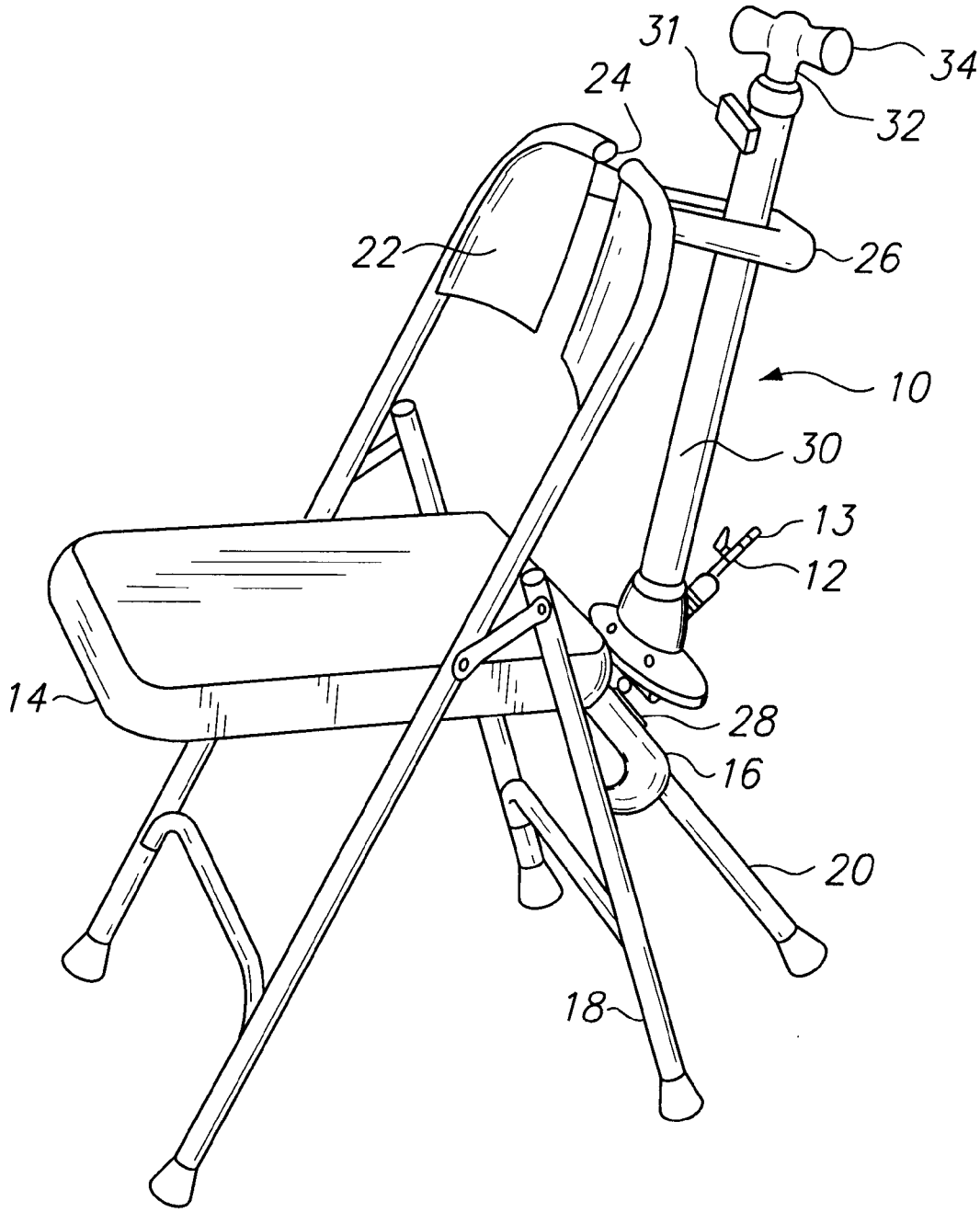
FIG. 1 is a side elevational view of the exercise apparatus hinged to a folding chair.

The hand pump of the invention may be an oil filled pump, a pneumatic pump or any other type as long as it can be easily adjusted to offer a controlled amount of resistance to its manipulation. In FIG. 1 the hand pump 10 is shown as being pneumatic with the resistance being provided by a manually controllable air valve 12 in the exhaust vent. Attached to the air valve is an acoustic announcer 13, a small whistle that emits a tone generated by the flow of exhausting air. Its use will be explained later.

FIG. 1 shows the pneumatic pump 10 pivotally connected to an inexpensive folding steel chair 14 that has been modified by adding a horizontal tubular cross bar 16 between the rear two legs 18 of the chair, adding a fifth leg 20 at an angle from the cross bar 16 to floor level to further stabilize the chair, cutting open the backrest 22 of the chair 14 to provide a slot 24 approximately three inches in width for passage of the hand pump 10, and installing a parking saddle 26 behind the slot 24 for limiting the angular movement of a hand pump, with lower end pivoted to the cross bar 16, between the seat of the open chair 14 and the parking saddle 26.

The hand pump 10 is firmly connected to the cross bar 16 directly under the slot 24 in the backrest 22 of the chair with a spring biased hinge 28 which is biased to continually urge the pump 10 toward the parking saddle 26. Thus, the chair 14 may easily be folded along with the mounted hand pump and can be conveniently stored while not in use.

The hand pump 10 comprises an elongated tube 30 that is sealed at both ends with an axial slidable shaft 32 emanating from the top sealed end. A digital counter 31 is attached to the tube and is advanced each time the shaft 32 is depressed. Shaft 32 has a cross handle 34 at the upper end and a piston and air check valve at the opposite end inside the tube 30. In a pneumatic hand pump such as being described, the piston is a pliable material for forcing air through an exhaust port and the manually adjustable valve 12, followed by the acoustic announcer 13.

The embodiment of FIG. 1 may be used in two modes. The user may stand behind the chair 14 and with hands gripping the handle 34 of the pump 10, he lifts the handle to its maximum height, leaning backward as required. Now the shaft 32 is at its maximum length. The user now pushes forward and, with his arms straight forward as in FIG. 2, applies his body weight on the handle 34. The restriction caused by the valve 12 in the exhaust port causes the handle to descend slowly and the escaping air through the acoustic announcer 13 generates a tone that alerts the user to inhale and hold his breath until the tone stops, and also sprays cooling air over the body of the user. The tone stops when the piston is at the bottom of the tube and there is no longer any exhausting air.

Figure 2:
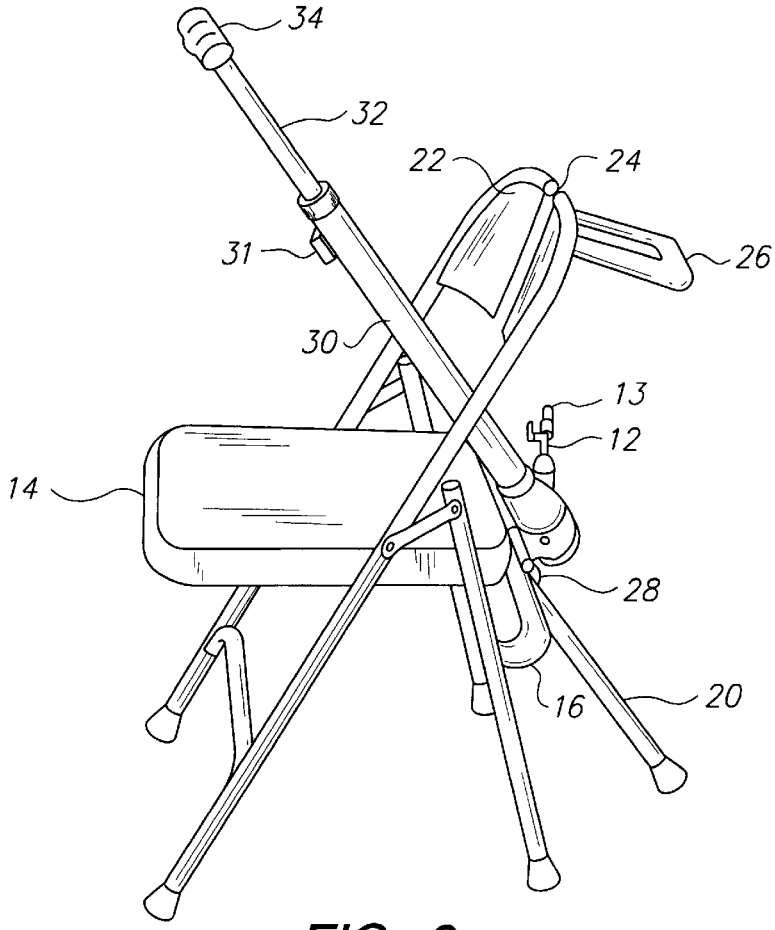
FIG. 2 is a side elevational view of the exercise apparatus pivoted toward the chair seat.

Alternatively, an exerciser user may use the chair embodiment of FIG. 1 by sitting, facing backward, straddling the seat of the chair 14 with a leg on each side. The user leans backward while lifting the handle 34, as shown in FIG. 2. At this topmost position of the handle, the user pushes the hand pump 10 forward, straightening his arms, and applying a downward force on the handle 34 which has the effect of pulling him up from the chair seat. The adjustment of valve 12 in the exhaust port controls the speed at which the handle 34 will descend and during the descent the acoustic announcer 13 will produce a tone for alerting the user of begin inhaling and holding his breath until the tone stops when the piston within the tube 30 is at the bottom of the stroke.

Figure 3:
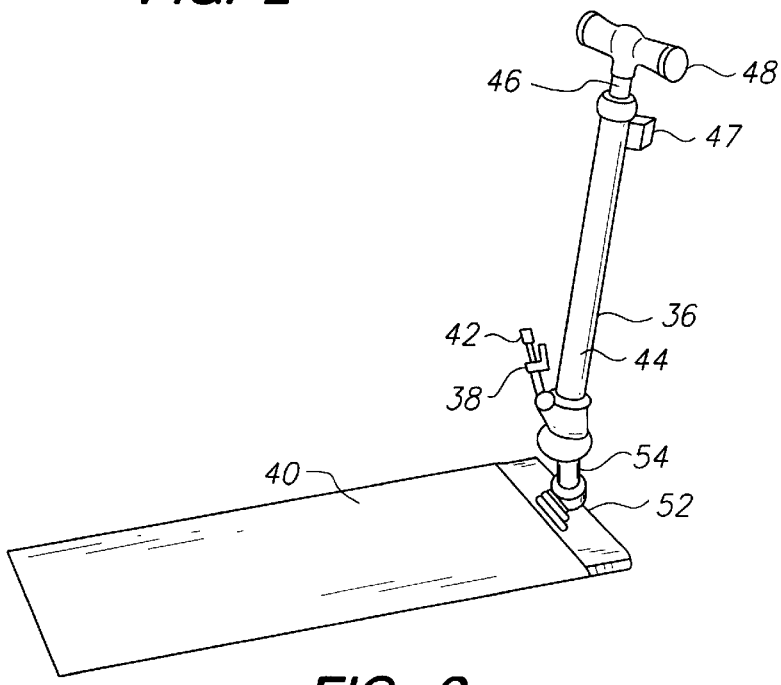
FIG. 3 is a perspective view of the exercise apparatus hinged on the end of a platform.

Turning to the embodiment illustrated in FIG. 3, a pneumatic hand pump 36 with its exhaust restricted by a manually adjustable valve 38 is hinged to one end of a step board 40 that may be approximately 10 inches wide and 30 inches long. Pump 36 is identical with the pump 10 of FIG. 1 and includes an acoustic announcer 42 on the valve 38 for developing a sound from the passage of exiting air, a tube 44 sealed at each end with a slidable shaft 46 through the center of the upper seal, a digital counter 47 on the exterior of the tube 44; and a handle 48 on the exterior end of the shaft 46. A piston 50 is at the opposite end of the shaft 46 within the tube 44, as shown in the sectional drawing of FIG. 5.

Figure 4:
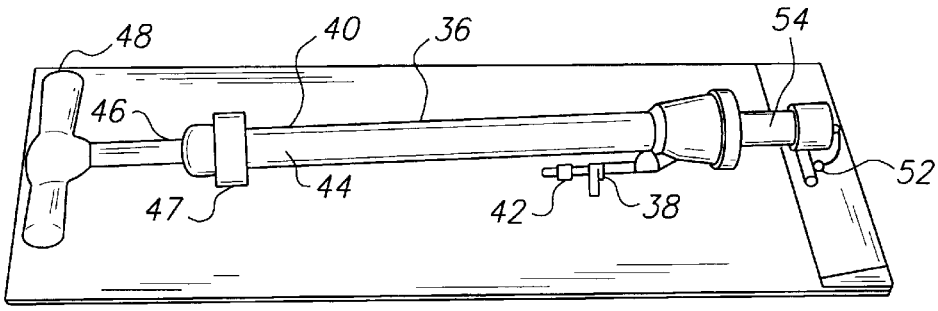
FIG. 4 illustrates the pump folded for storage on the platform of FIG. 3.

The lower end of the pump 36 is hinged to the step board 40 with a hinge 52 that enables the pump to rotate approximately 90° in the plane of the centerline of the step board 40, from the vertical to the surface of the step board, as shown in its storage position in FIG. 4. Actually however, the pump 36 can exceed these limitations because the lower end of the pump 36 is attached to a universal connection 54 which is attached to the restricting hinge 52. The universal connection 54 may be a ball and socket but is preferably a short section of rubber or thick rubber hose that offers a stiff but fairly flexible connection between pump 36 and hinge 52 that will permit the pump to be moved about 20° from the vertical.

Figure 5:
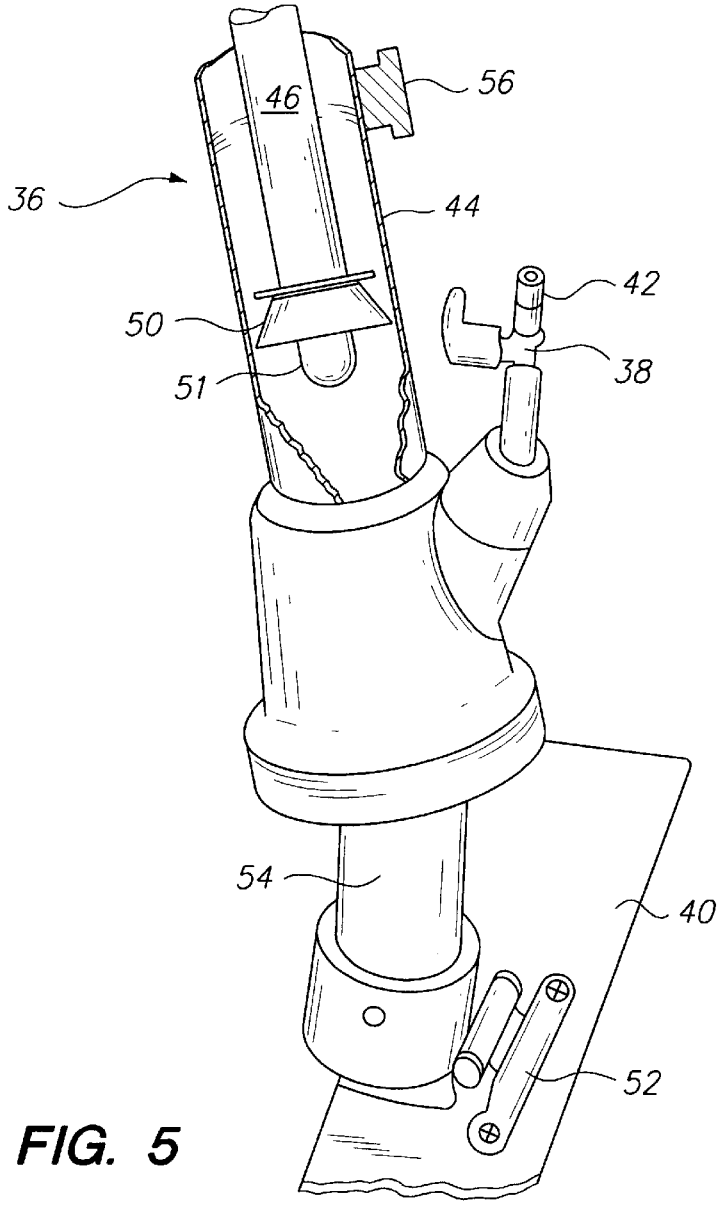
FIG. 5 is a sectional view of part of the interior of the pump and illustrates the details of mounting the pump to the platform of FIG. 4.

FIG. 5 is an enlarged view of the lower portion of the pump 36 showing, in section, a portion of the tube 44 containing the shaft 46 with the piston 50 and a rubber shock absorber 51 for noise reduction at the end. FIG. 5 also shows a portion of the step board 40 with the hinge 52 supporting a socket clamping one end of the rubber universal connection 54 attached to the lower end of the tube 44. The exit port with its manually controllable valve 38 and the attached acoustic announcer 42 is also shown.

In pneumatic pumps the pistons, such as piston 50, are usually made of rubber and when air is compressed by the piston, its temperature rises, often developing an unpleasant odor. Therefore, the invention includes an air deodorizer packet 56 attachable to the exterior surface of the pump tube 44 and at least partially in the cooling exhaust air flow from the valve 38 for neutralizing the unpleasant odors.

To help exercise the muscles on the step board, the user stands erect on the board 40, bends at the waist and lifts the handle 48 to its maximum. He then pushes forward, applying his body weight through his arms to the handle which slowly descends because of a nearly closed valve 38. During the descent cycle, the acoustic announcer 42 sounds and signal advising the user to begin inhaling and holding his breath. At the same time the cool air being exhausting from the valve 38 refreshes the user.

Figure 6:
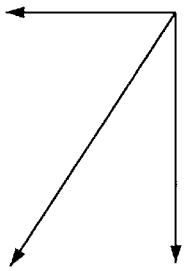
FIG. 6 is a vector diagram of the forces applied to the pump handle.

FIG. 6 is a vector diagram of the forces exerted during the descent of the handle 48 in the step board embodiment of FIGS. 4 and 5. The horizontal vector represents the forward pushing of the user as he applies his body weight to the handle 48. The vertical vector represents the body weight of the user, and the diagonal vector represents the resultant force on the handle 48 and the hinge 52.

Figure 7:
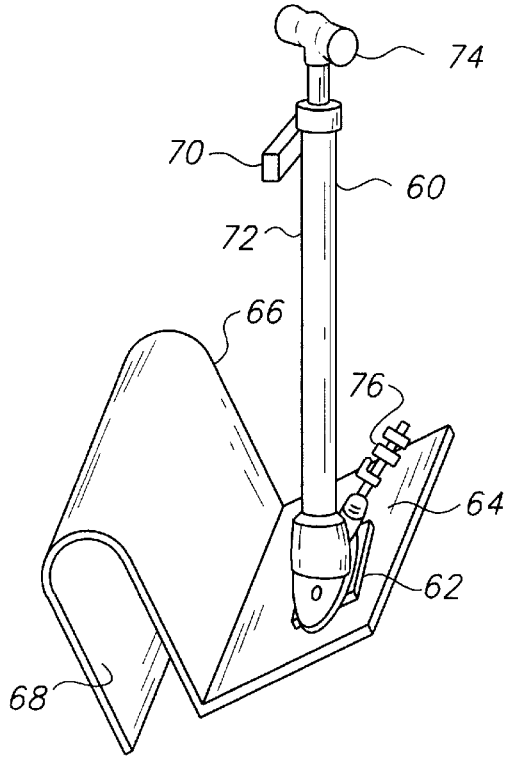
FIG. 7 illustrates the pump coupled to a large hook for hooking to the back of a sofa.

Yet another embodiment of the invention is a sofa mount hand pump illustrated in FIG. 7. Here a hand pump 60 is hinged by hinge 62 to the horizontal hook plate 64 of a bracket 66 having a wide "U" shaped hook 68 designed to hook over the back of a chair or sofa. The hand pump of FIG. 7 is identical with the hand pumps of FIGS. 1–4 and shows a digital counter 70 attached to the top of the tube 72 that adds a count each time the handle 74 reaches the bottom of a cycle.

Muscle toning and exercising is done with this embodiment in the same manner. The user standing erect, bends at the waist and, with arms straight, lifts handle 74 and forces it downward against the resistance provided by a valve 76 in the exhaust port of the pump.

Figure 8:
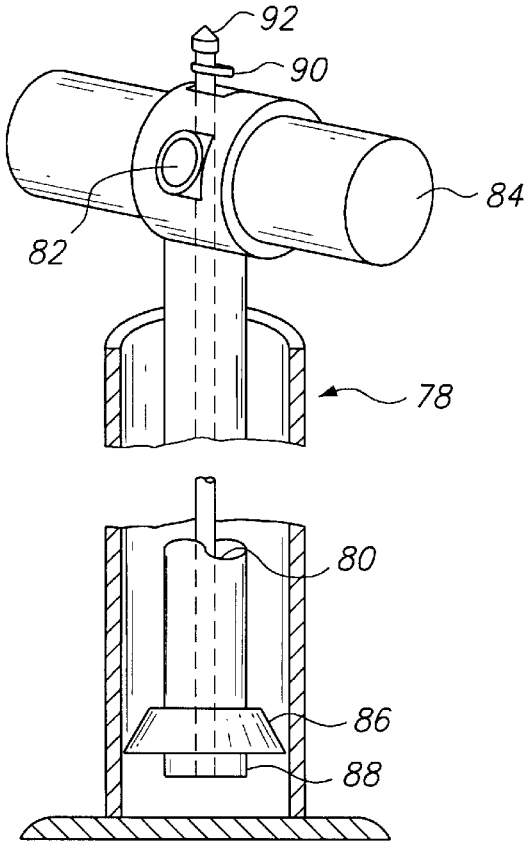
FIG. 8 illustrates an alternate embodiment of the hand pump with a thumb actuated air control.

FIG. 8 is a sectional view illustrating an alternate embodiment of the hand pump 78 with a tubular central shaft 80 with a thumb operated, normally open, air valve 82 conveniently located near the center of the handle 84 at the upper end and a piston 86 and shock absorber 88 at the lower end. The manually adjustable air valve 90 and the acoustic announcer 92 are in the exhaust port of the hand pump 78 which is now located at the upper end of the tubular central shaft 80 and these operate to control the air escape rate of the pump, as previously explained.

The thumb operated, normally open, air valve 82 permits air to flow freely through the tubular shaft 80 to the adjustable valve 90 and acoustic announcer 92. Momentarily depressing the valve 82 will momentarily stop the air flow. Repeated short duration depressing of the valve 82 will cause a descending shaft 80 transmits a shocking effect to the user's arms and shoulders similar to a strong massage.

What is claimed is:

1. A fluid hand pump exercising device, comprising:

a. an elongated tubular body having an interior, a first end, a second end, a first fluid port to said interior, and a second fluid port to said interior;

b. a slidable tubular shaft extending through said first end of said elongated tubular body and into the interior of said elongated tubular body, said slidable tubular shaft terminating in a piston lying within said interior of said tubular body, said slidable tubular shaft further terminating in a handle outside the interior of said tubular body;

c. a second manually adjustable valve located at said second fluid port to control the flow of fluid from said interior of said elongated tubular body;

d. a first fluid valve located at said first port of said tubular member, said first fluid valve located at said handle of said slidable tubular shaft and being in communication with said slidable tubular shaft; and e. means for pivotally mounting said second end of said tubular body to a stationary fixture.

2. The device of claim 1 wherein said pump is pneumatic.

3. The device of claim 2 wherein a portion of said slidable tubular shaft is covered with a rubber shock absorber.

4. The device of claim 2 further including an air driven acoustic announcer in said exhaust port following movements of said second manually adjustable valve.

5. The device of claim 2 further including a digital counter on said tubular body, said counter being advanced by said slidable tubular shaft.

6. The device of claim 1 including a wide U-shaped hook attached to said elongated tubular body for coupling said elongated tubular body to the back of a sofa or chair.

7. The device of claim 1 in which said second fluid valve is spring biased in a closed position.

8. A fluid hand pump exercising device, comprising:

a. an elongated tubular body having an interior, a first end, a second end and a fluid port to said interior;

b. a shaft extending through said first end of said elongated tubular body and into said interior of said elongated tubular body, said shaft terminating in a piston lying within said interior of said elongated tubular body and terminating in a handle lying outside the interior of said elongated tubular body;

c. a manually adjustable valve located at said fluid port to control the flow of fluid from the interior of said elongated tubular body;

d. a folding chair;

e. means for pivotally mounting said elongated tubular body to a folding chair, said folding chair including a cross-bar to hingedly attaching said elongated tubular body, and a backrest having an opening for pivoting at least a portion of said elongated tubular body therethrough; and f. a stabilizing leg depending from said cross bar.

* * * * *